United States Patent [19]

Newsom

[11] 4,227,357

[45] Oct. 14, 1980

[54] CONSTRUCTION BLOCKS

[76] Inventor: Bobby G. Newsom, General Delivery, Etty, Ky. 41523

[21] Appl. No.: 12,949

[22] Filed: Feb. 16, 1978

[51] Int. Cl.[2] ..... E04B 5/52

[52] U.S. Cl. ..... 52/344; 52/404; 52/747; 52/648; 52/415; 52/582

[58] Field of Search ..... 52/344, 378, 379, 404, 52/414, 588, 747, 293, 294, 652, 648, 581, 415, 582; 405/15, 16

[56] References Cited

U.S. PATENT DOCUMENTS

| | | | |
|---|---|---|---|
| 1,733,169 | 10/1929 | Purdy | 52/648 |
| 1,889,547 | 11/1932 | Green | 52/415 X |
| 2,049,907 | 8/1936 | Hess . | |
| 2,157,688 | 5/1939 | Cascio | 52/378 X |
| 2,933,166 | 4/1960 | Castaine | 52/582 |
| 3,744,194 | 7/1973 | Ramberg | 52/378 |

*Primary Examiner*—Price C. Faw, Jr.
*Assistant Examiner*—Carl D. Friedman
*Attorney, Agent, or Firm*—Harold Gell

[57] ABSTRACT

A construction method for fabricating structures and a system of building blocks utilized in the method is presented. The blocks are skeletal and formed from heavy gauge rods or bars with straight and hook projections that permit the blocks to be interconnected. Recesses are provided in the blocks so that an assembly of blocks will accommodate furring strips or stringers which will add to the structural integrity of the block structure and provide a nailing surface.

23 Claims, 4 Drawing Figures

CONSTRUCTION BLOCKS

THE INVENTION

This invention relates to a method for building a structure which is comprised of assembling a plurality of skeletal building blocks formed from rods or bars and the building block system incorporated in the method.

BACKGROUND OF THE INVENTION

Historically, man has created structures from masonary blocks. This form of building traces its ancestory from the earliest structures which were piles of rock to contemporary cut stone systems and from sun backed brick to the contemporary trend of utilizing kiln fired bricks and cast cement blocks.

Structures utilizing masonary techniques has become increasingly costly due to the labor and energy involved in transporting the materials to the place of construction and erecting the structure. Masonary items such as brick, cut stone or concrete block are extremely heavy and a significant amount of energy is expended transporting them from their place of origin to the building site. Furthermore, skilled masons are required to lay up the building blocks, whether they be brick stone or cement and mortar is required to secure the blocks together. Thus the cost of a masonary structure is a function of considerable energy expended in transporting the materials and a significant amount of skilled labor in handling the mortar and blocks.

A second contemporary means of construction consists of fabricating a structure from a framework of sawn boards and covering the framework with siding and plater board type materials. This latter method of construction is not as sturdy as the block construction and like the block system, does not provide adequate thermal insulation. Furthermore, the wooden structure is prone to fire and insect damage and it requires constant maintenance to prevent deterioration.

OBJECTIVES OF THE INVENTION

In view of the obvious shortcomings of the various contemporary building methods, it is an objective of this invention to provide a building block which may be assembled by an unskilled laborer without the aid of mortar to create structures having plumb walls and square corners and insulative and structural integrity that is greater than masonary techniques but requires less man power to assemble than a woodframe structure.

A further objective of the present invention is to provide a method for fabricating a structure which includes assembling a number of blocks comprised of pre-formed rods or bars.

A still further objective of the present invention is to provide a building structure comprised of a plurality of interlocking blocks fabricated from formed rods or bars which include interlocking appendages.

It is a further objective of the present invention to provide a building module fabricated from rods or bars that are shaped in the form of a block and incorporate appendages that will interlock the modules to permit fabricating a structure to meet the needs of the user.

Another objective of the present invention is to provide a method for building a structure comprised of assembling formed skeletal modules, inserting nailing strips in recesses provided therein, securing external and internal facing materials to the modules by nailing the facing materials to the nailing strips and filling the void between the internal and external facing panels with an insulating material.

A still further objective of the present invention is a provide a method for building a structure comprised of assembling formed skeletal modules, inserting nailing strips in recesses provided therein, securing facing materials to one side of the modules by nailing the facing materials to the nailing strips and spraying a masonary or resinous insulating and weatherproofing material over the exposed side of the skeletal modules and back to the facing materials to complete a wall structure.

The foregoing and other objectives of the invention will become apparent in light of the drawings, specification and claims contained herein.

SUMMARY OF THE INVENTION

Presented hereby is a building block or module which is fabricated by forming metal, plastic, fiberglass, or any other suitable rod like materials to create a skeletal structure having dimensions approximately equivalent to contemporary building blocks. The skeletal building blocks include recesses formed in at least one side along the midline which are dimensioned to receive nailing strips to which a facing panel may be secured. The skeletal blocks are provided with appendages which lock on to adjacent blocks so that a structure may be fabricated by stacking the blocks in a conventional staggered manner similar to that used in masonary construction.

A structural wall formed from a plurality of the skeletal blocks is completed by inserting nailing strips in the provided recesses and nailing a facing material along one or both sides of the block wall. Insulating material may be inserted in the hollow spaces between the facing materials or if desired, facing material may be applied to only one side of the wall and the other completed by spraying a masonary product or other suitable material over the exposed skeletal structure and back of the facing material to build up a thickness equivalent to the width of the blocks.

DESCRIPTION OF THE INVENTION

Figure 1:
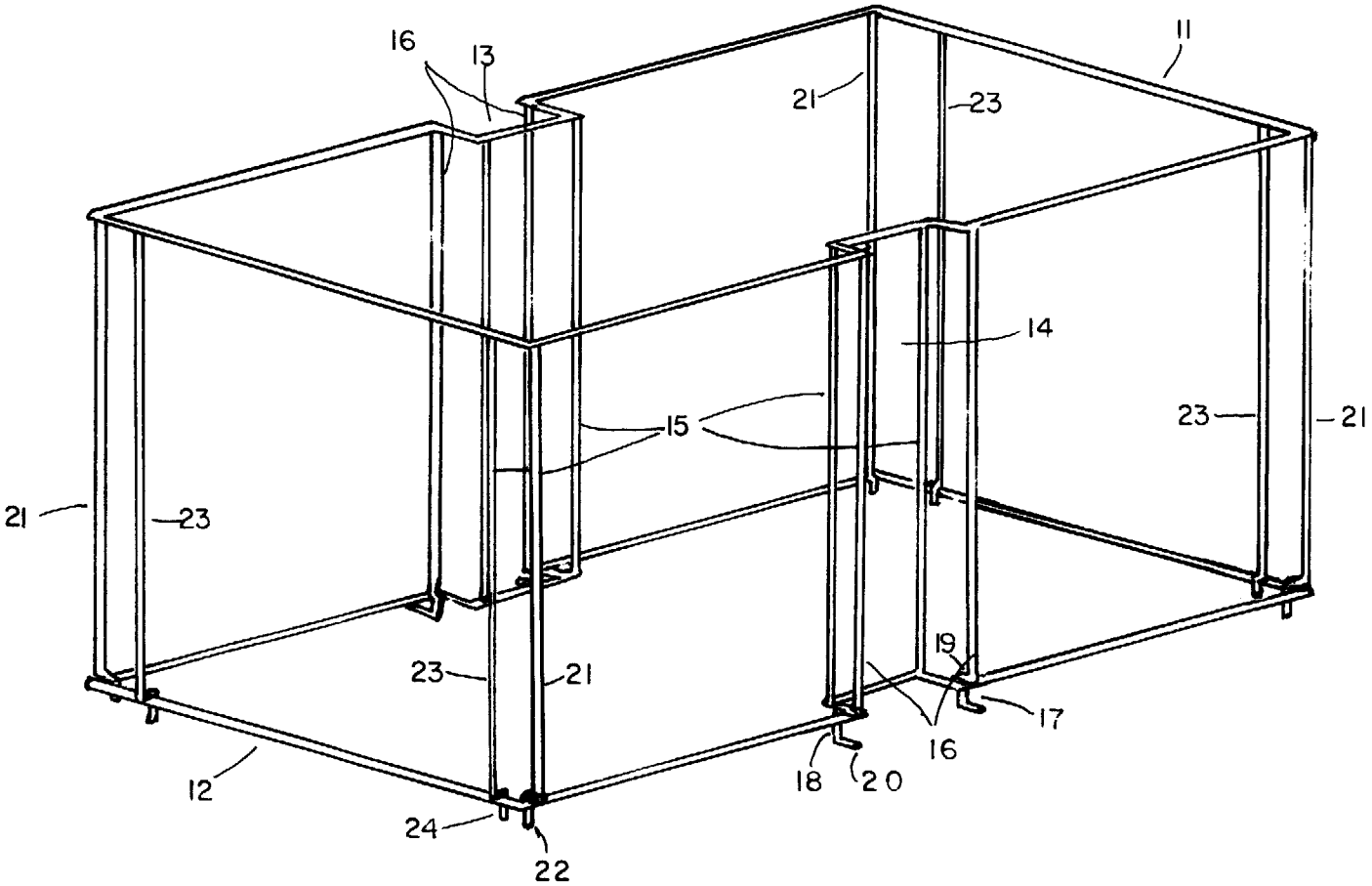
FIG. 1 is a 3-4 view of a preferred embodiment of the building block of the present invention.

FIG. 1 illustrates the basic, skeletal building block upon which this invention is predicated and which is incorporated in the various methods of structure fabrication taught herein. The block is comprised of a framework which may be fabricated from a metal rod or heavy gauge wire calculated to meet the anticipated stress which will be encountered in the structure fabricated from a plurality of similar blocks. The materials for forming the structure of the block do not have to be metal rod or wire. They can be bar or sheet shaped and fabricated from metal, platic, fiberglass, boron filament, or a wide variety of materials having the required physical properties which will enable the creation of a strong and resilient structure.

The preferred embodiment illustrated in FIG. 1 incorporates a top rectangular section 11 and a bottom rectangular section 12. Both the top and bottom rectangular sections are exactly identical in shape and dimension and include rectangular recesses 13 and 14 located at the midpoint of each side. These recesses are dimensioned to receive furring or nailing strips which will permit facing material to be secured to the blocks.

The top and bottom rectangular sections 11 and 12 are joined by a plurality of rod like structures of equal length so that the top and bottom rectangular sections 11 and 12 will be parallel in the completed skeletal block.

In FIG. 1, four rods 15 are located at the inside corners of the furring strip receiving recesses 13 and 14. These rods may be secured to the top and bottom rectangular structures by any convenient means but in the preferred embodiment they are welded in place.

The outer corners of the furring strip receiving recesses of the top 11, and bottom 12 rectangles are joined together by rods 16 which are secured to the top and bottom rectangular frameworks in a manner similar to that described for rods 15. The bottom ends of rods 16 incorporate a rectangularly shaped hook section 17 dimensioned to cooperate with the top rectangular section of a block position immediately beneath it. To accomplish this, the rectangular hook section 17 has an upper section 18 which is perpendicular to the major portion of rod 16 connecting the top and bottom rectangles together. The perpendicular section 18 has an inside face that is equal in length to the diameter of the material forming the bottom rectangular structure 12. A section 19 descends from section 18 in a plane parallel to the major portion of the rod which interconnects the top and bottom rectangles. Section 19 has an inner face which has a dimension equivalent to the diameter of the material forming the bottom rectangle 12 plus the diameter of the material forming the top rectangle 11 of the skeletal block to which it is going to be attached. A lower section 20 extends from section 19 parallel to section 18. Section 20 has an inner face length equal to the diameter of the top rectangular section of the block to which the illustrated block is to be secured. Thus, the bottom portion of the connnecting rods 16 incorporate a hook section 17 which is generally rectangular in shape and which forms a recess that will accommodate the rod structure of the bottom rectangle of the block into which rod 16 is incorporated and the rod structure of the top rectangle of the skeletal block to which the illustrated block is to be attached.

Figure 2:
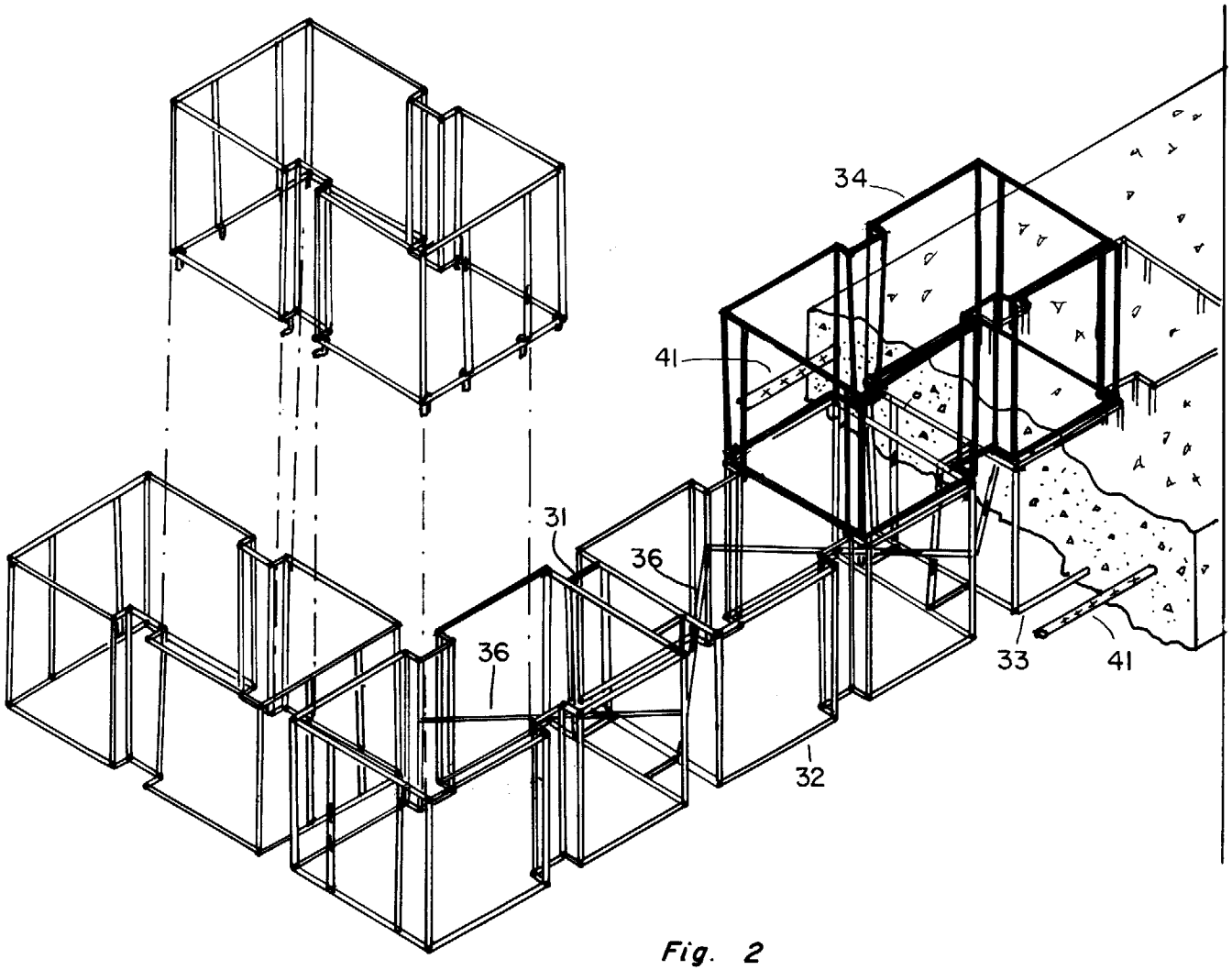
FIG. 2 is a cutaway view illustrating a base structural strip embodiment of the present invention.
Figure 3:
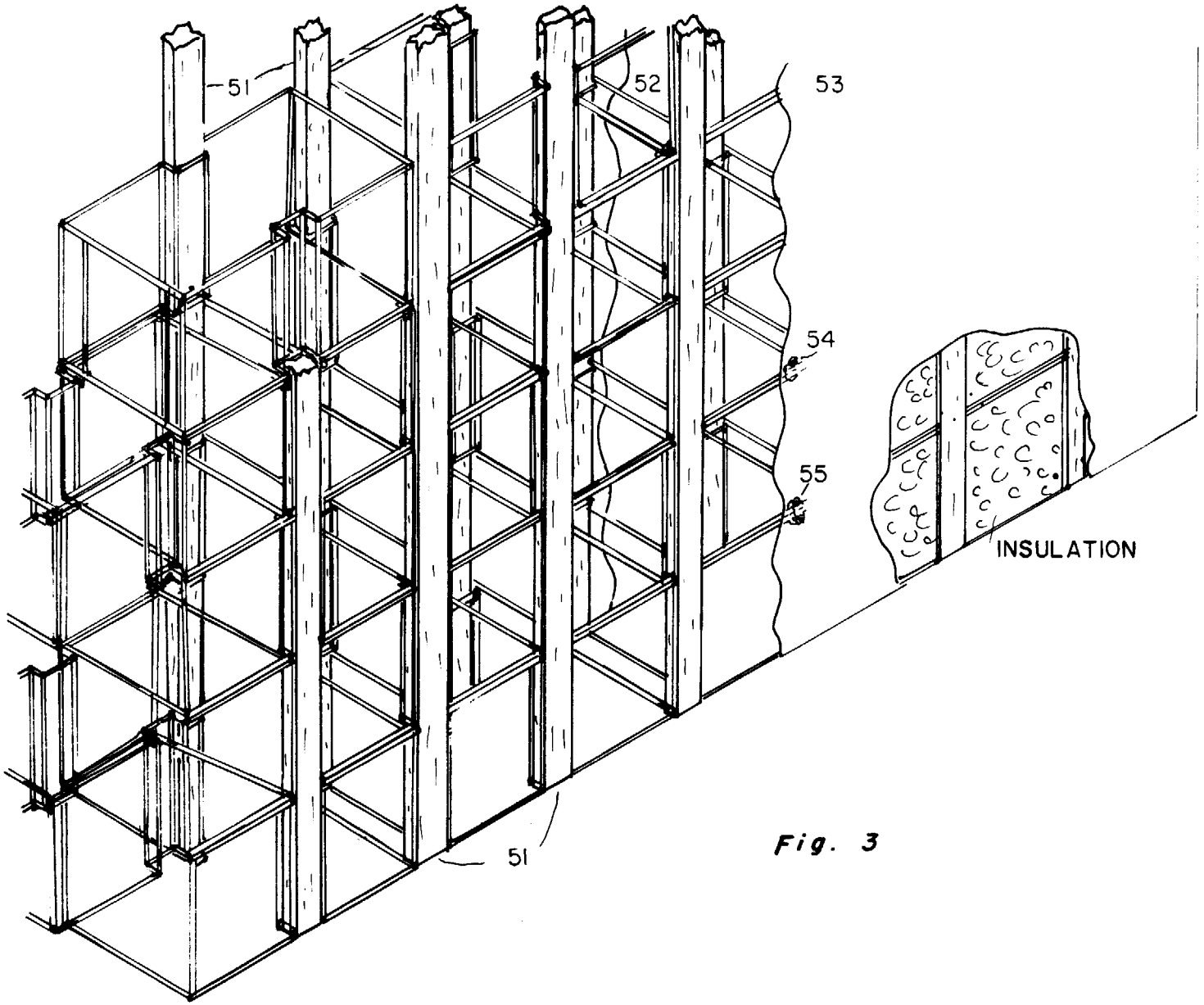
FIG. 3 is a cutaway view illustrating a wall fabricated from the structural blocks of the present invention and incorporating facing paneling on both sides.
Figure 4:
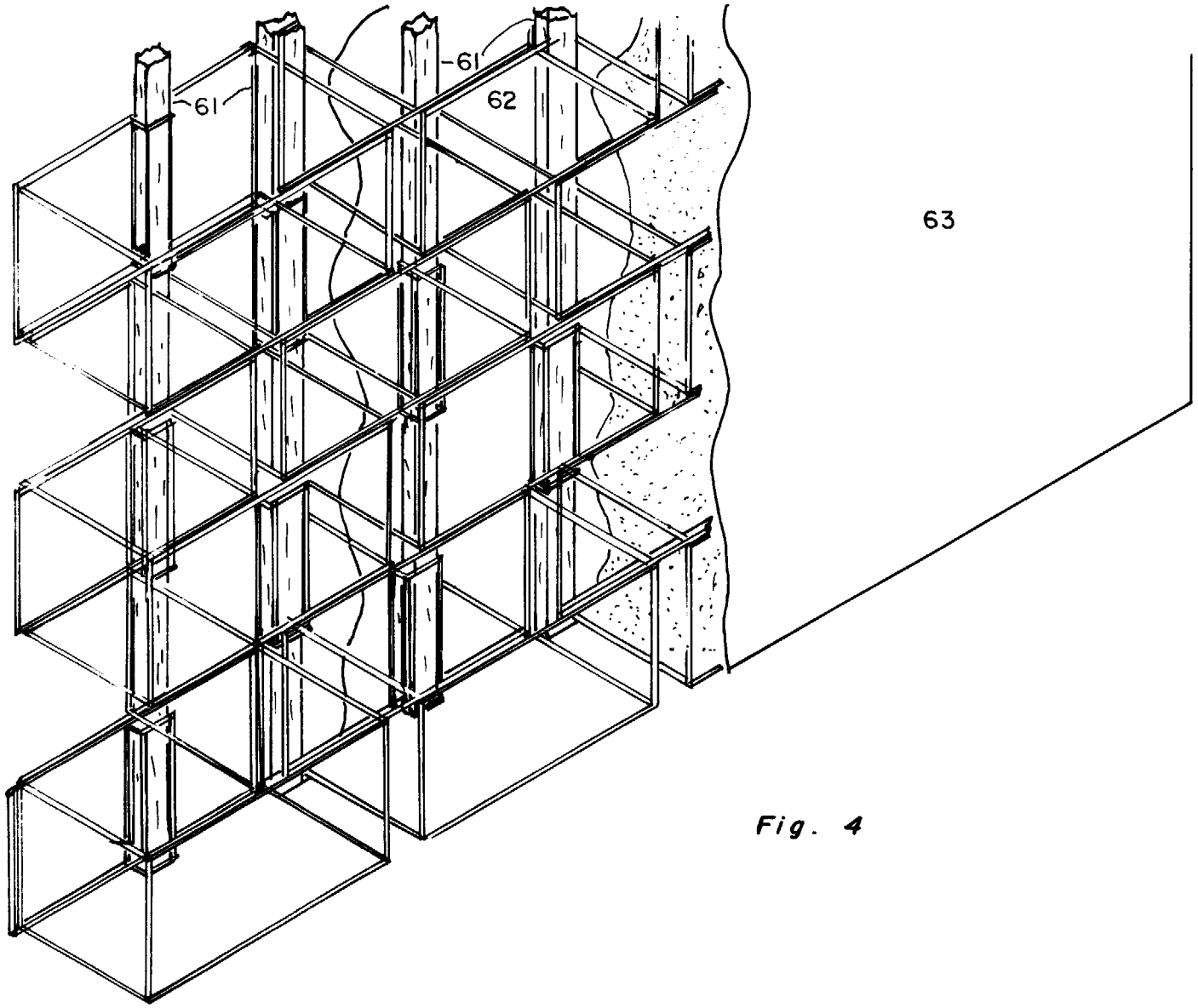
FIG. 4 is a cutaway view of a wall fabricated from structural blocks of the present invention utilizing facing paneling on one side and sprayed material on the other.

In assembling a structure similar to that illustrated in FIGS. 2, 3, and 4, the hook sections 17 engage the top rectangle of the lower block structure when the sides of the bottom rectangle are compressed to allow the bottom portions 20 of the hooks 17 to pass the top rectangle of the lower block and then allowed to return to their normal position due to the resiliency of the materials with which the lower rectangular section 12 is fabricated.

The corners of the top rectangle 11 and bottom rectangle 12 are joined by vertical rods 21 which are secured in a fashion similar to the rods 15 and dimensioned so that the top and bottom rectangles will be parallel when the block is assembled. The corner support rods 21 incorporate an off set section 22 which passes around the rod structure of the bottom rectangle 12 and descends a distance therebelow which is equal to at least the diameter of the structure of the top rectangle of the block to which the illustrated block is to be attached to. When the blocks are assembled in a staggered fashion, the off set portions 22 of corner rods 21 will occupy a position immediately behind vertical support rods 16 of the block located directly below and the hook sections 17 will engage the top rectangular frame of the lower block immediately behind the corner brace rods 21 of the lower block.

In the preferred embodiment illustrated in FIG. 1, additional vertical rods 23 are positioned inboard of the corner rods 21. The vertical rods 23 incorporate an off set portion 24 located at the bottom which is similar to the off set portion 22 of vertical rods 21. Vertical rods 23 are secured between the top and bottom rectangular structures in a manner similar to that utilized for the other vertical rods in the structure and they are displaced from the corner rods a distance which will cause the off set portions 22 to be adjacent to the sides of the rectangular recess in the lower block, see FIGS. 2, 3 and 4.

FIG. 2 illustrates a footer string which is comprised of a plurality of skeletal blocks similar to that illustrated in FIG. 1 except the vertical rods 16, 21 and 23 are the same lengths as rods 15 and they do not incorporate their respective hooks or off set portions 17, 22 or 24.

The trunk line section of FIG. 2 is comprised of a plurality of skeletal blocks which are interconnected by securing the blocks together with sections of rod 31 which may be secured to adjacent top rectangular sections or bottom rectangular sections by welding or any other convenient means dependent upon the materials used. The interconnecting rod sections 31 are dimensioned so that a space will be created between adjacent skeletal block which is equivalent to the recesses in the sides of the top and bottom rectangles of the blocks. Thus when blocks are assembled in a staggered fashion as illustrated, a continuous channel is formed between the space between blocks and the rectangular channel in the side of the block immediately above, see the interrelationship between blocks 32, 33 and 34.

The trunk line section may be braced by securing bracing rods 36 between selected vertical rods of the blocks forming the trunk line section. This technique may be utilized to brace additional sections of the wall after the blocks have been assembled to the trunk line section. However, if additional bracing is utilized between the blocks secured to the top of the trunk line sections, any additional welding or similar fastening step will have to be incorporated in the wall assembly process. It is anticipated that trunk line sections will be placed in a concrete footer by placing the trunk line in the footer excavation along with the reinforcing rods 41 before the footer is poured. This will result in the bottom rectangle sections of the blocks comprising the trunk line forming part of the footer reinforcing network and it will eliminate the need for a portion of the reinforcing metal required by most building codes.

Trunk line sections similar to those illustrated in FIG. 2 may also be used as the top course of blocks in a wall to provide a more rigid support for roof or floor beams. The top course of a wall may also be covered with a plate such as a large timber or steel beam to provide a rigid surface for supporting beams. Shorter trunk line sections may also be used as lintels over window or door openings.

FIG. 3 illustrates a wall constructed from a plurality of blocks similar to those illustrated in FIG. 1. The blocks may be assembled on trunk line sections to those illustrated in FIG. 2 with the trunk line set in a concrete footer or secured to the floor surface by some other convenient means. If desired, the trunk sections may be eliminated and the lower course of blocks may be comprised of standard blocks as illustrated in FIG. 1 but positioned in an inverted orientation so that the bottom rectangular sections of the lower course of skeletal blocks will mate with the lower rectangular sections of the second course of blocks. This will provide additional security between the first and second course of skeletal blocks and provide a level surface without hook or off set protrusions to facilitate setting the wall on a wood surface or an existing concrete surface.

When a basic wall is assembled from the skeletal blocks as illustrated in FIG. 3, nailing strips 51 are forced into the channels formed by the rectangular recesses in the sides of the skeletal blocks and by the spaces between adjacent blocks. In a preferred embodiment, the skeletal blocks are 14⅜ inches long and the rectangular recesses are 1⅝ inches wide so that when the blocks are assembled in a wall in a staggered fashion as illustrated in FIG. 3, the nailing strips will be on 16 inch centers. Any convenient dimensions may be utilized for the blocks, however to be compatible with the standards currently used in the industry for masonary blocks and various code requirements for 16 inch centers for studding, it is suggested that the preferred dimensions for the skeletal blocks would be 14⅜ inches long by 8 inches high with widths similar to those used in concrete blocks such as 2 inches, 4 inches, 6 inches, 8 inches and 12 inches. The rectangular recesses may be any size desired, but it is suggested that an internal dimesnion of the recesses equal to 1⅝ inches wide by ¾ inch deep so that the resultant channels will accept a commercially available standard wood strip.

Once the nailing strips 51 have been inserted in the channels created by the blocks, a facing material 52 and 53 may be nailed to the nailing strips 51. If the wall is an outside wall, the exterior facing panel 52 may be similar to the sheeting used in frame structures, aluminum siding or any convenient weatherproof material. The interior side of the wall 53 may be faced with wall board, paneling or any desired paneling material.

In an alternate embodiment of the present invention, the nailing strips may be eliminated and the panel material may be secured directly to the rods forming the skeletal blocks with hook or U bolts 54 and 55 respectively. If this method of fastening the paneling material to the skeletal blocks is utilized, the rectangular recesses in the sides of the blocks may be eliminated. The rectangular recesses may be eliminated on one or both sides without destroying the integrity of the structure or the ease of assembly. For instance, the blocks on the left side of FIG. 3 are illustrated with no nailing strip channels but block spacing is maintained because the hook sections 17 of upper blocks cooperate with the corners of lower blocks.

After the wall facings 52 and 53 have been installed, insulating material 56 may be poured between facing panels 52 and 53 to create a wall having insulating qualities significantly better than prior art structures.

FIG. 4 illustrates an alternate wall construction where a facing panel 62 is secured to the wall via nailing strips 61 or similar means such as suggested with respect to FIG. 3. After the facing panel 62 is installed, the skeletal block side of the wall is coated with a sprayed on structural material such as cement applied with a spray technique or stucco to a thickness which will cover the blocks and provide a smooth, wear and weather resistant surface 63.

The nailing strip channels are not required in the sprayed side of the wall illustrated in FIG. 4 but their inclusion will not destroy the integrity of the wall. Thus, standard blocks having recesses on both sides may be used for all types of construction anticipated for the skeletal block of the present invention.

As previously suggested, a wide variety of materials may be utilized to fabricate the construction blocks described herein. However, the preferred embodiment anticipates the use of steel rods or wires which may be formed in a wire bending machine and then welded together to form the blocks. The table below indicates the anticipated compressive strength of wire blocks formed from 3/16 inch, 7/32 inch and ¼ inch diameter steel wire.

| | |
|---|---|
| 3/16 $\phi$ Wire | $P = \frac{20IE}{mf^2}$ |
| (Block wt. = 1.735 pounds) | $P = \frac{20 \times .00006 \times 30{,}000{,}000}{1 \times (7.635)^2}$ |
| | P = 619,188 Pounds/Wire × 16 Wires = |
| | P = 9907 Pounds/Block Pounds |
| 7/32 $\phi$ Wire | $P = \frac{20IE}{mf^2}$ |
| (Block wt. = 2.357 pounds) | $P = \frac{20 \times .00011 \times 30{,}000{,}000}{1 \times (7.625)^2}$ |
| | P = 1135.1787 Pounds/Wire × 16 Wires = |
| | P = 18.162 Pounds/Block Pounds |
| ¼ $\phi$ Wire | $P = \frac{20IE}{mf^2}$ |
| (Block wt. = 3.083 pounds) | $P = \frac{20 \times .000195 \times 30{,}000{,}000}{1 \times (7.625)^2}$ |
| | P = 2012.3623 Pounds/Wire × 16 Wires = |
| | P = 32,197 Pounds/Block |

The commpressive strength does not vary as a function of the block size because 16 vertical wires are used whether the blocks are 2 inches wide or 12 inches wide. However, the block weight will vary as a function of the material incorporated in the top and bottom rectangular structures. The block weights given in the table above are exemplary for 8 inch wide blocks.

A typical method of building a wall utilizing the skeletal construction blocks of the present invention is to prepare a footer excavation, lay in the reinforcing rod, lay in trunk line sections the length of the wall to be constructed, and pour the concrete footer. After the footer has set, skeletal construction blocks are connected to the trunk line section and interconnected by compressing the lower sides of a block so that that hook sections 17 will pass inside the rectangular top sections. Once the hook sections 17 have passed inside the rectangular top section of a lower block, the compressive force is released and the resiliency of the structure snaps the hook sections about the top section of the lower block so that an assembly similar to that illustrated in FIGS. 2, 3 and 4 is created. Alternate methods may be used to secure the blocks together, for instance the hook and off set portions 17, 22 and 24 of FIG. 1 may be eliminated and the blocks may be secured by welding them in place or bolting them together with U bolts. If desired, additional rigidity may be incorporated into the structure utilizing the preferred hook and off set sections by welding the blocks together after they have been secured together by the hook section 17 and off set sections 22 and 24.

Regardless of the means to secure the skeletal construction blocks together, additional rigidity may be incorporated into the structure if desired by performing the steps of positioning bracing means similar to the bracing wires 36 of FIG. 2 within the wall structure and welding the bracing wires to the blocks.

When the block wall has been constructed, nailing strips are forced into the channels and facing panel nailed to the nailing strips. If desired, a wall may be insulated by performing the step of pouring an insulating material in the void formed by facing panels on either side of the construction.

An aternate method of completing the wall structure may be accomplished by building a wall as previously described and facing only one side with a facing material. After the facing panel has been installed, cement may be blown over the wire block and against the facing panel to a thickness which exceeds the width of the wire block so that a smooth concrete surface results.

Another alternate means of finishing the structure is to build a wall and face it on one side using the steps previously set forth and attaching brick ties to the remaining unfinished side of the wall. When the brick ties have been affixed to either nailing strips or directly to the skeletal construction blocks, a brick or stone course may be laid against the blocks to create a desired decorative effect. After the brick or stone course has been laid, the space between the interior facing panel and the brick or stone work may be insulated by pouring an insulating material such as fiberglass between the two wall faces.

While preferred embodiments of this invention have been illustrated, variations and modifications may be apparent to those skilled in the art. Therefore, I do not wish to be limited thereto and ask that the scope and breadth of this invention be determined from the claims which follow rather than the above description.

What I claim is:

1. A construction block, comprising:

a top frame;

a bottom frame shaped identical to said top frame and forming the bottom perimeter of said construction blocks;

a plurality of support members secured between said top frame and said bottom frame, said support members dimensioned to cause said top frame and said bottom frame to lie in superposed and parallel orientation with respect to each other;

said top and bottom frames configured to form a rectangle with a furring strip receiving recess formed in the mid-section of one side to create the top and bottom perimeters of said construction block, said top and bottom perimeters including first and second sections encompassing equal areas joined by an area of lesser width created by said recess; and said construction block fabricated from formed and welded metal rods.

2. A construction block as defined in claim 1 wherein a plurality of said support members include hook section means extending beyond said construction block for engaging the frame of an adjacent construction block.

3. A construction block as defined in claim 1 wherein a plurality of said support members include off set extension means extending from said frame of said construction block for interlocking said construction block to an adjacent block, said off set extension means dimensioned to fit within the frame of an adjacent block when said construction block and the adjacent block are superimposed.

4. A construction block as defined in claim 1 wherein said plurality of support members comprises:

a first plurality of support members including hook means extending from said construction block frame for engaging the frame of an adjacent construction block; and a second plurality of said plurality of support members including extension means protruding beyond said construction block frame for interlocking said construction block with an adjacent construction block.

5. A construction block as defined in claim 4 wherein said top frame comprises:

first and second sides; and said recess is formed in said first side and said second side as a mirror image of said first side.

6. A construction block as defined in claim 5 wherein said top frame is rectangular in shape and said plurality of support members including said extension means are connected between said top frame and said bottom frame at the corners thereof.

7. A construction block as defined in claim 5 wherein said plurality of support members including said hook means are interconnected between said top frame and said bottom frame at the outer corners formed where said recessed section is stepped inward from said first side.

8. A construction block as defined in claim 5 wherein said plurality of support members including said hook means comprises four support members, each of which is connected at a corner formed on the outer side of said top frame at the point where said top frame turns inward to create said recessed section;

said plurality of support members including said extension means comprising eight support members, one each of which is positioned at each corner of said top frame and one each of which is positioned on a side of said top frame perpendicular to said side containing said recessed section a distance from said nearest corner equal to the depth of said recessed section; and said support members are parallel.

9. A construction block as defined in claim 1 wherein said top frame comprises first and second sides and said recess is formed in said first side and said second side as a mirror image of said first side.

10. A trunk line, comprising:

a plurality of construction blocks interconnected to form a series of blocks in a common plane; each of said construction blocks comprising:

a top frame;

a bottom frame shaped identical to said top and forming the bottom perimeter of said construction blocks;

a plurality of support members secured between said top frame and said bottom frame, said support members dimensioned to cause said top frame and said bottom frame to lie in superposed and parallel orientation with respect to each other;

said top and bottom frames configured to form a rectangle with a furring strip receiving recess formed in the mid-section of one side to create the top and bottom perimeters of said construction block, said top and bottom perimeters including first and second sections encompassing equal areas joined by an area of lesser width created by said recess; and said construction block fabricated from formed and welded metal rods.

11. A wall, comprising:

a plurality of construction blocks, each of which comprises:

a top frame;

a bottom frame shaped identical to said top frame and forming the bottom perimeter of said construction block;

a plurality of support members secured between said top frame and said bottom frame, said support members dimensioned to cause said top frame and said bottom frame to lie in superposed and parallel orientation with respect to each other;

said top and bottom frames configured to form a rectangle with a furring strip receiving recess formed in the mid-section of one side to create the top and bottom perimeters of said construction block, said top and bottom perimeters including first and second sections encompassing equal areas joined by an area of lesser width created by said recess;

said construction blocks fabricated from formed and welded rods;

said construction blocks interconnected to form an integral unit; and a facing panel means secured to one side of said integral unit of said construction blocks for forming a wall.

12. A wall as defined in claim 11, further comprising a second facing panel means secured to the side of said construction blocks opposite said facing panel means.

13. A wall as defined in claim 12, further comprising insulating material positioned between said facing panel means and said second facing panel means.

14. A wall as defined in claim 11, further comprising a coating sprayed through said construction blocks onto the construction block side of said facing panel to a thickness covering said construction blocks.

15. A wall comprising:

a plurality of construction blocks fabricated from formed and welded metal rods, each of which comprises:

a top frame configured to define the top perimeter of said construction block;

a bottom frame shaped identical to said top frame and forming the bottom perimeter of said construction block;

a plurality of support members secured between said top frame and said bottom frame, and said support members dimensioned to cause said top frame and said bottom frame to lie in superposed and parallel orientation with respect to each other and form first and second sides;

a first plurality of said support members including hook section means extending beyond said construction block for engaging the frame of an adjacent construction block;

a second plurality of said support members including off-set extension means extending from said frame of said construction block for interlocking said construction block to an adjacent block, said off-set extension means dimensioned to fit within the frame of an adjacent block when said construction block and the adjacent block are positioned one above the other;

said first side includes a recessed section located at the midpoint thereof;

said top frame is rectangular in shape and said second plurality of support members including said extension means are connected between said top frame and said bottom frame at the the corners thereof;

said first plurality of support members including said hook means are interconnected between said top frame and said bottom frame at the outer corners formed where said recessed section is stepped inward from said first side; and a facing panel means secured to the side of said construction blocks.

16. A wall as defined in claim 15, further comprising a second facing panel means secured to the side of said construction blocks opposite said facing panel means.

17. A wall as defined in claim 16, further comprising insulating material positioned between said facing panel means and said second facing panel means.

18. A wall as defined in claim 15, further comprising a coating sprayed through said construction blocks onto the construction block side of said facing panel to a thickness covering said construction blocks.

19. A method for forming a wall, including the steps of:

laying down a first course of skeletal construction blocks;

building additional courses of skeletal construction blocks on said first course by positioning individual skeletal construction blocks over adjoining halves of two skeletal construction blocks in a lower course and compressing the sides of said skeletal construction block so that hook members attached thereto can pass within said lower construction blocks;

releasing said compressive force on the sides of said skeletal construction blocks so that said hook members may engage the top frames of the two lower adjacent construction blocks; and securing a facing panel to said assembly of said skeletal construction blocks.

20. A method of fabricating a wall, including the steps of:

erecting a plurality of courses of construction blocks of the type formed of rods and dimensioned so that they have a channel formed in their sides for receiving nailing strips by positioning individual ones of said construction blocks over adjoining halves of said construction blocks in a lower course and compressing the sides of said construction blocks so that hook members attached thereto can pass within said lower construction blocks;

inserting nailing strips in said channels; and nailing facing material to said nailing strip.

21. A method for building a wall, including the steps of:

assembling a plurality of courses of skeletal building blocks by positioning individual skeletal building blocks over joining halves of two skeletal building blocks in a lower course and compressing the sides of said skeletal building blocks so that hook members attached thereto can pass within the lower skeletal building blocks; attaching facing material to one side of said assemblage of skeletal building blocks; and coating the side of said facing material attached to said skeletal building blocks with a hardenable material to a thickness great enough to cover said skeletal building blocks.

22. A method of constructing a wall, including the steps of:

preparing a footer excavation; laying a course of skeletal building blocks in said footer excavation;

pouring concrete in said footer excavation to a depth which does not cover the top frame of said skeletal building blocks; and securing a plurality of courses of skeletal building blocks on said course of skeletal building blocks set in said concrete footer.

23. A construction block, including:

a plurality of metal rods formed and welded together to form a framework defining a rectangular construction block including a channel in the center section of one side dimensioned to receive a furring strip flush with the perimeter of said construction block when placed therein.

* * * * *